US009279431B2

(12) United States Patent
Rossi et al.

(10) Patent No.: US 9,279,431 B2
(45) Date of Patent: Mar. 8, 2016

(54) METHOD AND EQUIPMENT FOR DETECTING ROTATING STALL AND COMPRESSOR

(71) Applicant: Nuovo Pignone S.P.A., Firenze (IT)

(72) Inventors: David Rossi, Firenze (IT); Daniele Galeotti, Firenze (IT)

(73) Assignee: Nuovo Pignone S.P.A., Florence (IT)

( * ) Notice: Subject to any disclaimer, the term of this patent is extended or adjusted under 35 U.S.C. 154(b) by 581 days.

(21) Appl. No.: 13/686,290

(22) Filed: Nov. 27, 2012

(65) Prior Publication Data

US 2013/0142617 A1 Jun. 6, 2013

(30) Foreign Application Priority Data

Dec. 2, 2011 (IT) ..... CO2011A0056

(51) Int. Cl.
*F04D 27/02* (2006.01)
*F04D 29/66* (2006.01)
*F04D 27/00* (2006.01)

(52) U.S. Cl.
CPC ..... *F04D 29/661* (2013.01); *F04D 27/001* (2013.01)

(58) Field of Classification Search
CPC ..... F04D 27/001
USPC ..... 73/660, 112.06; 415/1
See application file for complete search history.

(56) References Cited

U.S. PATENT DOCUMENTS 6,092,029 A 7/2000 Bently
6,532,433 B2 3/2003 Bharadwaj et al.
7,677,090 B2 * 3/2010 Moen ..... F02C 7/045 73/112.01
2004/0037693 A1 2/2004 Stabley et al.
2010/0296914 A1 11/2010 Staroselsky et al.
2013/0309060 A1 * 11/2013 Johnsen ..... 415/1

FOREIGN PATENT DOCUMENTS

CN 1675470 A 9/2005
WO 2007086755 A1 8/2007
WO 2009055878 A2 5/2009

OTHER PUBLICATIONS

Unofficial English Translation of Chinese Office Action issued in connection with corresponding CN Application No. 201210501258.0 on Sep. 1, 2015.

* cited by examiner

*Primary Examiner* — John Chapman, Jr.
(74) *Attorney, Agent, or Firm* — GE Global Patent Operation

(57) ABSTRACT

A method for detecting rotating stall in a compressor is disclosed herein. The method comprises measuring radial vibration of the rotor relative to the stator and generating a vibration measurement signal, calculating a frequency spectrum of the vibration measurement signal, identifying a plurality of frequency bandwidths of the frequency spectrum, neglecting one first frequency bandwidth of the plurality of frequency bandwidths if the rotation frequency of the rotor falls within the first frequency bandwidth, neglecting at least one second frequency bandwidth of the plurality of frequency bandwidths if the rotation frequency of the rotor falls below the second frequency bandwidth, determining the maximum magnitude of the spectrum in each of the non-neglected frequency bandwidths, and comparing each determined maximum magnitude and a predetermined value. Rotating stall is considered occurring if at least one of the comparisons shows that the corresponding determined maximum magnitude is greater than the predetermined value.

13 Claims, 6 Drawing Sheets

METHOD AND EQUIPMENT FOR DETECTING ROTATING STALL AND COMPRESSOR

BACKGROUND OF THE INVENTION

Embodiments of the present invention disclosed herein generally relate to a method and apparatus for detecting rotating stall in a compressor, in particular in a centrifugal compressor.

Rotating stall, also known as rotational stall, is a local disruption of airflow within a compressor which continues to provide compressed fluid but with reduced effectiveness.

Rotating stall arises when a small proportion of aerofoils experience aerofoil stall, disrupting the local airflow without destabilizing the compressor. The stalled aerofoils create pockets of relatively stagnant fluid (referred to as stall cells) which, rather than moving in the flow direction, rotate around the circumference of the compressor. The stall cells rotate with the rotor blades, but at a lower speed, affecting subsequent aerofoils around the rotor as each encounters the stall cell.

A rotating stall may be momentary, resulting from an external disturbance, or may be steady as the compressor finds a working equilibrium between stalled and unstalled areas. Local stalls substantially reduce the efficiency of the compressor and increase the structural loads on the aerofoils encountering stall cells in the region affected.

In many cases, however, the compressor aerofoils are critically loaded without capacity to absorb the disturbance to normal airflow such that the original stall cells affect neighboring regions and the stalled region rapidly grows to become a complete compressor stall which is commonly known as surge. If surge continues and no action is taken to stop it, the rotor blades will be severely damaged and, eventually, the whole compressor will be damaged.

Therefore, it is important to try to avoid surge in a compressor.

U.S. Pat. No. 6,092,029 discloses a method and an apparatus for diagnosing rotating stall of a rotating machinery by monitoring dynamic shaft precession of the machine and comparing this precession with a standard one and altering the precession as the machine approaches a destabilizing condition when indicated by the comparison step. Axial vibration monitoring means is also provided for monitoring and comparing a dynamic axial vibration of the machine with that of a standard one and altering the axial vibration as the machine approaches a destabilizing condition when indicated by the comparison step. Furthermore, the complex dynamic stiffness of the machine is measured and the direct dynamic stiffness and the quadrature dynamic stiffness are computed for use as a destabilizing warning.

U.S. Pat. No. 6,532,433 discloses a method and an apparatus for continuous prediction, monitoring and control of compressor health via detection of precursors to rotating stall and surge; at least one sensor is operatively coupled to the compressor for monitoring at least one compressor parameter. According to the embodiments, a plurality of sensors are disposed about the casing of the compressor for measuring dynamic compressor parameters such as, for example, pressure, velocity of gasses flowing through the compressor, force, vibrations exerted on the compressor casing. A system is connected to the sensor for computing stall precursors. According to an embodiment, compressor data are measured as a function of time, FFT is performed on the measured data and changes in magnitudes at specific frequencies are identified and compared with baseline compressor values.

US2004/0037693 discloses a system and method for detecting rotating stall in a centrifugal compressor, particularly in the diffuser region of a centrifugal compressor. The process begins with the detection or sensing of acoustic energy associated with the onset of rotating stall. A pressure transducer is placed in the gas flow path downstream of the impeller, preferably in the compressor discharge passage or the diffuser, to measure the sound or acoustic pressure phenomenon. Next, the signal from the pressure transducer is processed either using analog or digital techniques to determine the presence of rotating stall. Rotating stall is detected by comparing the detected energy amount, which detected energy amount is based on the measured acoustic pressure, with a predetermined threshold amount corresponding to the presence of rotating stall.

US2010/0296914 discloses a stall and surge detection system and method for a compressor. The system comprises a vibration monitor that monitors radial vibrations, axial vibrations and axial displacement. According to a first embodiment, radial vibrations in one fixed and predetermined frequency bandwidth based on the minimum operating rotating speed of the rotor of the compressor, specifically from 2.5 Hz to 45 Hz, are monitored for detecting incipient surge, i.e. rotating stall. According to a second embodiment, using a tracking filter, tracked to the rotational frequency of the rotor of the compressor, radial vibrations in the range of frequencies from e.g. 5% of the rotational frequency to e.g. 90% of the rotational frequency are monitored for detecting incipient surge, i.e. rotating stall.

WO2009/055878 discloses a method to avoid instable surge conditions with centrifugal compressors. The method provides to measure and/or calculate forces on the bearings of the rotor of the compressor, and to detect timely exceptional imbalance of radial forces on the bearings which occurs before the centrifugal compressor ends up in an unstable condition. According to one embodiment, the component of the radial forces which is synchronous with the rotational frequency of the rotor is eliminated.

Therefore, there are solutions in the prior art that detect one or more indicators of an incipient surge in a compressor; some of these known solutions monitor the axial vibration of the compressor.

There is still a need for a solution to the problem of detecting incipient surge that is accurate, simple and flexible.

BRIEF SUMMARY OF THE INVENTION

Embodiments of the present invention relate to a method and apparatus for detecting rotating stall in a compressor, in particular in a centrifugal compressor.

In one embodiment of the present invention a method is provided for detecting rotating stall in a compressor comprising a rotating rotor and a static stator, the rotor and the stator being subject to radial vibration and axial vibration. The method comprises measuring radial vibration of the rotor relative to the stator and correspondingly generating a vibration measurement signal, calculating a frequency spectrum of the vibration measurement signal and identifying a plurality of frequency bandwidths of the frequency spectrum. The method further comprises neglecting one first frequency bandwidth of the plurality of frequency bandwidths if the rotation frequency of the rotor falls within the first frequency bandwidth, neglecting at least one second frequency bandwidth of the plurality of frequency bandwidths if the rotation frequency of the rotor falls below the second frequency bandwidth. The method also includes determining the maximum magnitude of the spectrum in each of the non-neglected frequency bandwidths, and carrying out a comparison between each of the determined maximum magnitudes and a predetermined value. Rotating stall is considered occurring if at least one of the comparisons shows that the corresponding determined maximum magnitude is greater than the predetermined value.

In another embodiment of the invention an apparatus is provided for detecting rotating stall in a compressor comprising a rotating rotor and a static stator, the rotor and the stator being subject to radial vibration and axial vibration. The apparatus comprises at least one sensor configured to measure radial vibration of the rotor relative to the stator and correspondingly generate a vibration measurement signal, and an electronic processing unit. The electronic processing unit is configured to calculate a frequency spectrum of the vibration measurement signal, identify a plurality of frequency bandwidths of the frequency spectrum, neglect one first frequency bandwidth of the plurality of frequency bandwidths if the rotation frequency of the rotor falls within the first frequency bandwidth, and neglect at least one second frequency bandwidth of the plurality of frequency bandwidths if the rotation frequency of the rotor falls below the second frequency bandwidth. The electronic processing unit is further configured to determine the maximum magnitude of the spectrum in each of the non-neglected frequency bandwidths, carry out a comparison between each of the determined maximum magnitudes and a predetermined value, and signal a rotating stall condition if at least one of the comparisons shows that the corresponding determined maximum magnitude is greater than the predetermined value.

In another embodiment of the invention a compressor is provided comprising at least one rotating rotor and a static stator, and an apparatus for detecting rotating stall. The apparatus comprises at least one sensor configured to measure radial vibration of the rotor relative to the stator and correspondingly generate a vibration measurement signal, and an electronic processing unit. The electronic processing unit is configured to calculate a frequency spectrum of the vibration measurement signal, identify a plurality of frequency bandwidths of the frequency spectrum, neglect one first frequency bandwidth of the plurality of frequency bandwidths if the rotation frequency of the rotor falls within the first frequency bandwidth, and neglect at least one second frequency bandwidth of the plurality of frequency bandwidths if the rotation frequency of the rotor falls below the second frequency bandwidth. The electronic processing unit is further configured to determine the maximum magnitude of the spectrum in each of the non-neglected frequency bandwidths, carry out a comparison between each of the determined maximum magnitudes and a predetermined value, and signal a rotating stall condition if at least one of the comparisons shows that the corresponding determined maximum magnitude is greater than the predetermined value.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

BRIEF DESCRIPTION OF THE DRAWINGS

The accompanying drawings, which are incorporated in and constitute a part of the specification, illustrate one or more embodiments and, together with the description, explain these embodiments. In the drawings.

These drawings are schematic, simplified and not in scale, as it is evident for a person skilled in the art.

DETAILED DESCRIPTION OF EXEMPLARY EMBODIMENTS OF THE INVENTION

The following description of the exemplary embodiments refers to the accompanying drawings. The same reference numbers in different drawings identify the same or similar elements. The following detailed description does not limit embodiments of the invention. Instead, the scope of embodiments of the invention is defined by the appended claims. The following embodiments are discussed, for simplicity, with regard to the terminology and structure of a centrifugal compressor. However, the embodiments to be discussed next are not limited to this kind of system, but may be applied for example to axial compressors.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
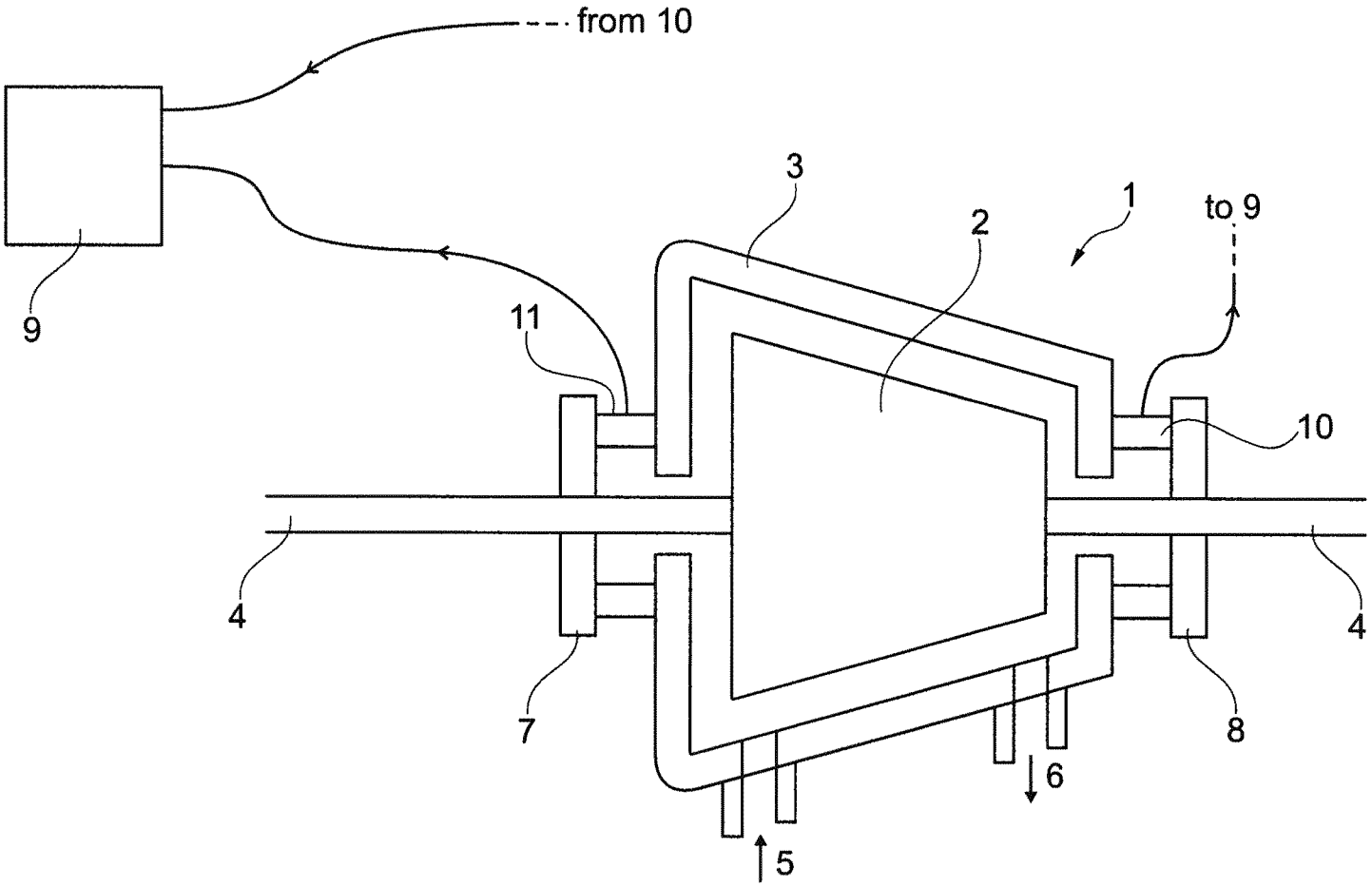
FIG. 1 shows a first compressor with associated a first embodiment of the equipment according to an embodiment of the present invention.

A compressor 1, like the one shown in FIG. 1, comprises a rotating rotor 2 and a static stator 3; in FIG. 1, the stator 3 corresponds to the casing of the compressor 1. The rotor 2 is mounted on a rotating shaft 4 that is supported on one side by first bearings 7 and on the other side by second bearings 8. The compressor 1 has an inlet 5 for an uncompressed fluid and an outlet 6 for a compressed fluid; during normal operation, a fluid enters the compressor 1 through the inlet 5 is compressed by the rotation of the rotor 2 and exits the compressor 1 through the outlet 6.

Figure 6:
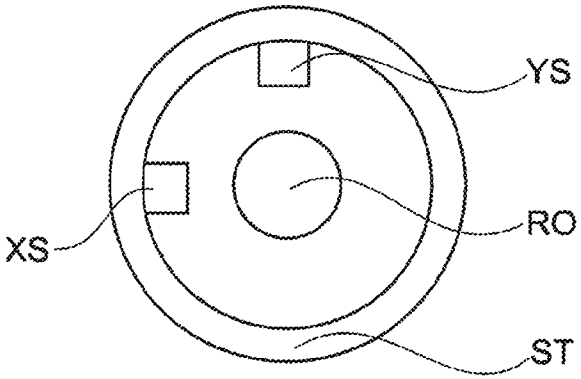
FIG. 6 shows schematically a detail of FIG. 5.

During normal operation, both the compressor rotor and the compressor stator are subject to both radial and axial vibration. When rotating stall occurs at one or more areas of the blades of the rotor, vibrations establish in the compressor that lead to a radial vibration of the rotor relative to the stator; the word "radial" refers to the rotation axis of the rotor and of its shaft. As the stator is static, i.e. fixed to the ground, most of the movement caused by the radial vibration is with the rotor and its shaft. In FIG. 6, the radial vibration is measured by two sensors 10 and 11 that continuously measure the distance of the shaft 4 with respect to the casing 3; a first sensor 11 is located close to the first bearings 7 on a first side of the rotor 2 and a second sensor 10 is located close to the second bearings 8 on a second side (opposite to the first side) of the rotor 2.

In FIG. 1, there is also shown an electronic processing unit 9, that may be a computer (e.g. a Personal Computer). Each of sensors 10 and 11 generates a corresponding radial vibration measurement signal that is transmitted to the unit 9 through an appropriate connection (e.g. a wire) for being treated. In this way, radial vibration of the compressor 1 is continuously monitored by the unit 9 through the processing of the signals received from the sensors 10 and 11. The unit 9 comprises appropriate hardware and software for determining if a rotating stall is occurring in the compressor 1 based on the signals received from the sensors 10 and 11, or, in other words, if there is an "incipient surge" in the compressor 1; additionally, the unit 9 may comprise appropriate hardware and software for determining if "surge" is occurring in the compressor 1 based on the signals received from the sensors 10 and 11; "incipient surge" and/or "surge" may be signaled by the electronic processing unit 9 to a human operator and/or to another electronic processing unit of the same electronic system (e.g. a compressor monitoring and controlling system) and/or to a remote electronic system. FIG. 1 does not show any electronic system.

The combination of unit 9 and sensors 10 and 11 (not excluding other components) can be considered an "equipment for detecting rotating stall"; the combination of compressor 1, unit 9 and sensors 10 and 11 (not excluding other components) can be considered an "improved compressor"; these two statements are valid in general, e.g. when number and kind of sensors different from FIG. 1 are used.

Figure 7:
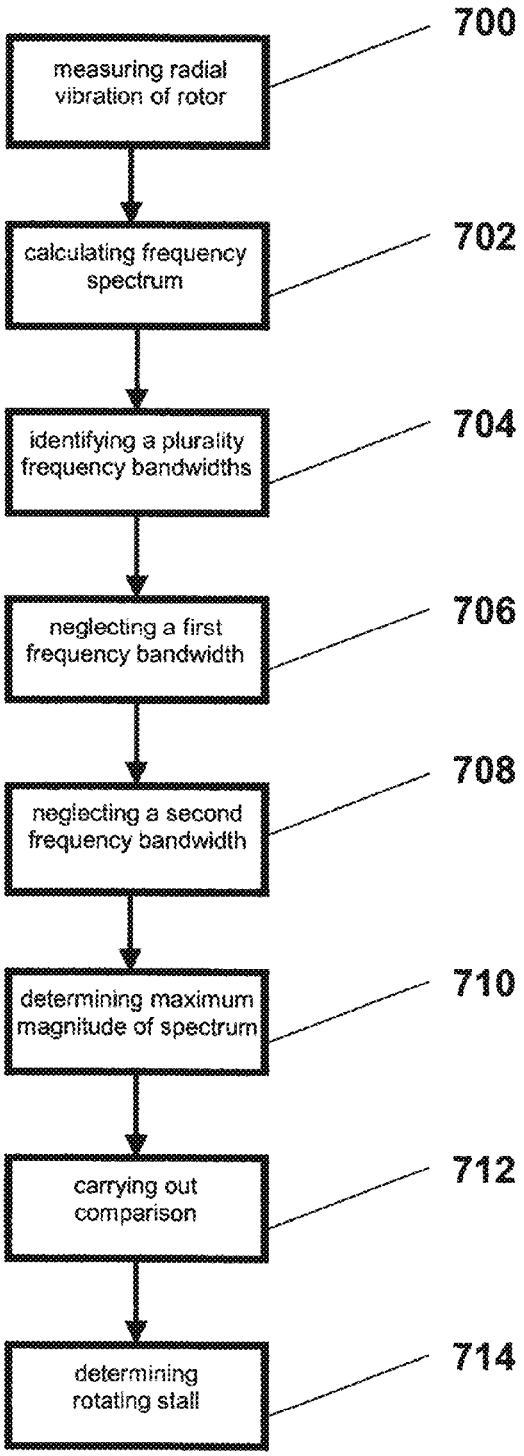
FIG. 7 shows a flow chart of a method according to an embodiment of the present invention.

Processing within the unit 9 will be now explained with reference to FIG. 1 and FIG. 7; such processing is used for detecting rotating stall; the first step to be carried out 700 is measuring radial vibration of the rotor 2 relative to the stator 3 and correspondingly generating at least one vibration measurement signal and is carried out by sensors 10, 11 external to the electronic processing unit 9.

During operation of the compressor 1, considering for the moment only the first sensor 11 and its vibration measurement signal, the unit 9 carries out the following steps of calculating a frequency spectrum of the vibration measurement signal 702, identifying a plurality of frequency bandwidths of the frequency spectrum 704, neglecting one first frequency bandwidth of the plurality of frequency bandwidths, if the rotation frequency of the rotor falls within the first frequency bandwidth (depending on the position, number and width of the bandwidths of plurality as well as the regime of the compressor when rotating stall detection occurs, there may be nothing to neglect in this step) 706, neglecting at least one second frequency bandwidth of the plurality of frequency bandwidths, if the rotation frequency of the rotor falls below the second frequency bandwidth (depending on the position, number and width of the bandwidths of plurality as well as the regime of the compressor when rotating stall detection occurs, there may be nothing to neglect in this step) 708, determining the maximum magnitude of the spectrum in each of the non-neglected frequency bandwidths 710, and carrying out a comparison between each of the determined maximum magnitudes and a predetermined value 712.

Rotating stall is considered occurring 714 if at least one of the comparisons shows that the corresponding determined maximum magnitude is greater than the predetermined value.

For the sake of clarity, the frequency spectrum of a time-domain signal is a representation of that signal in the frequency domain.

The frequency spectrum can be generated via a FT (Fourier Transform) of the signal, and the resulting values are usually presented as amplitude and phase, both plotted versus frequency. Due to the fact that the unit 9 is an electronic processing unit, the Fourier transform is computed as a DFT (Discrete Fourier Transform), through the FFT (Fast Fourier Transform) algorithm.

Figure 4:
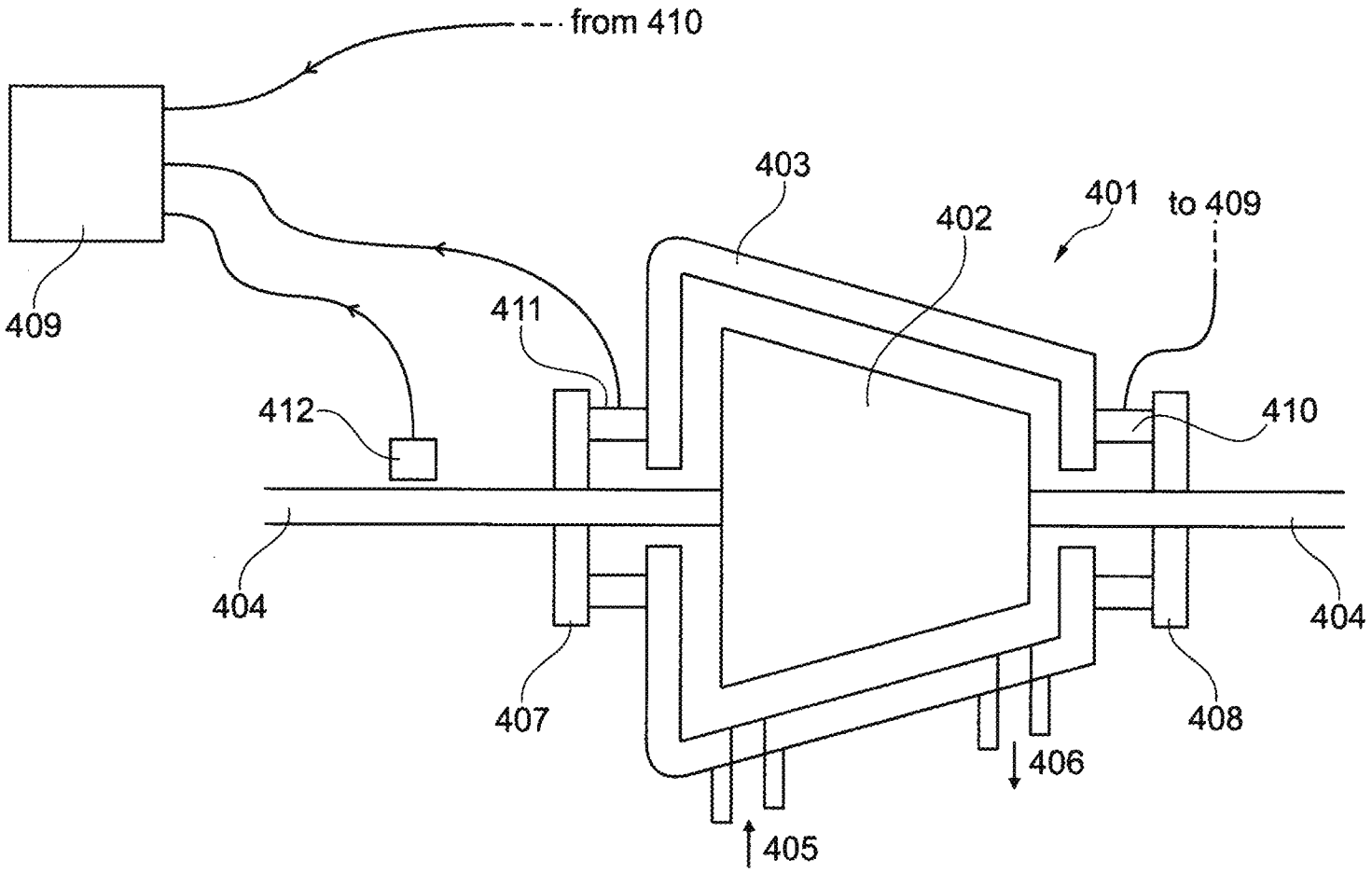
FIG. 4 shows a second compressor with associated a second embodiment of the equipment according to an embodiment that differs from the first embodiment of FIG. 1 in that it measures the rotation frequency of rotor.

Neglecting one first frequency bandwidth of the plurality of frequency bandwidths, if the rotation frequency of the rotor falls within the first frequency bandwidth and neglecting at least one second frequency bandwidth of the plurality of frequency bandwidths, if the rotation frequency of the rotor falls below the second frequency bandwidth, requires that the current rotation frequency of the rotor be known when the stall detection is carried out; this may be done either by indirect measurement FIG. 1 or by indirect measurement FIG. 4 as it will be better explained afterwards; it is to be noted that very often the rotation speed of the compressor is measured for other reasons and therefore the same measurement can be used also for stall detection with an precise and effective result.

In order to detect stall, determining the maximum magnitude of the spectrum in each of the non-neglected frequency bandwidths comprises determining the maximum magnitude in each bandwidth; anyway, for other purposes (e.g. "troubleshooting"), it might be useful to identify also the frequency corresponding to the maximum magnitude.

The above steps are repeated by the unit 9 (typically periodically) for monitoring the compressor with regard to rotating stall. In order to avoid considering momentary vibrations peaks, it is advantageous that in determining the maximum magnitude of the spectrum in each of the non-neglected frequency bandwidths an average operation is carried out between magnitudes in a number (e.g. two or three or four) of consecutives time intervals.

The above method implemented by an electronic processing unit is based on the observation that when there is a rotating stall in a compressor, radial vibration of considerable amplitude is created having a frequency between 10% and 85% of the rotation frequency of the compressor rotor, more typically between 20% and 80% of the rotation frequency of the compressor rotor.

Figure 2A:
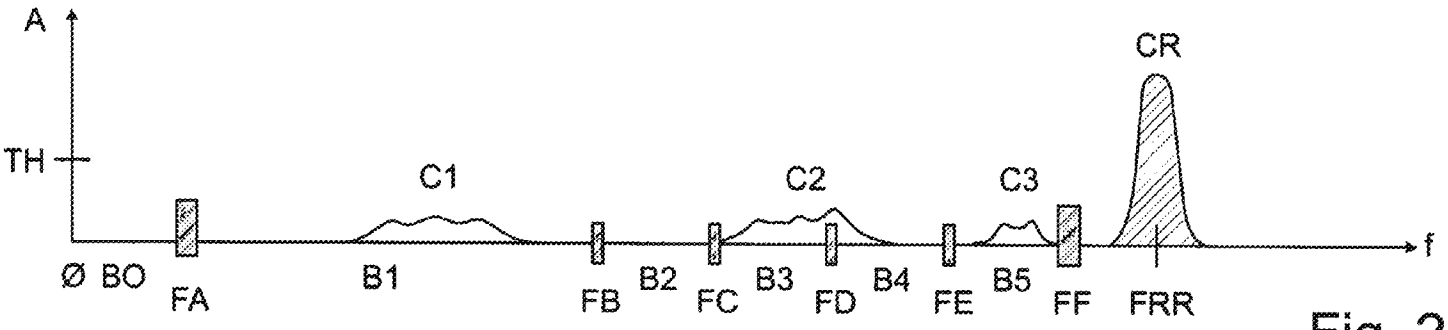
FIG. 2A shows a first spectrum of the radial vibration amplitude of a rotating compressor in a first regime (rated speed) and a first example of a plurality of frequency bandwidths used for detecting rotating stall according to an embodiment of the present invention.
Figure 2B:
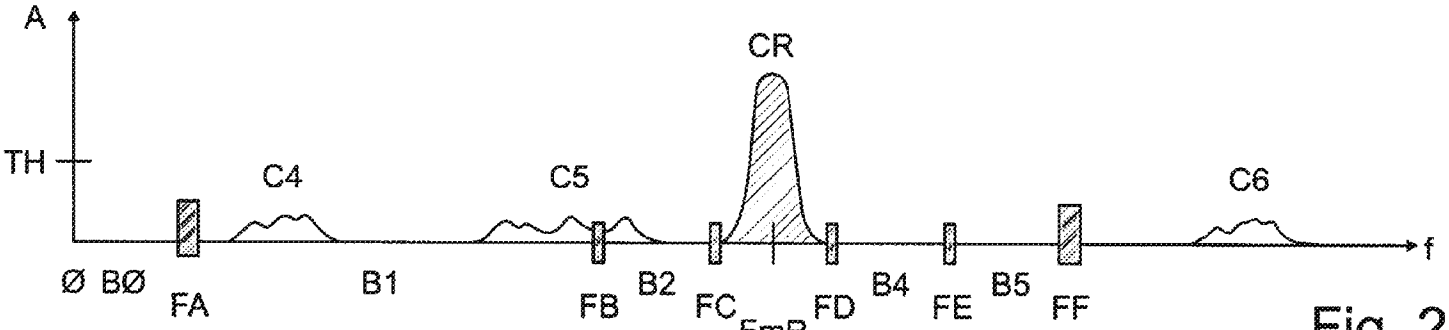
FIG. 2B shows a second spectrum of the radial vibration amplitude of a rotating compressor in a second regime (minimum operating speed) and a first example of a plurality of frequency bandwidths used for detecting rotating stall according to an embodiment of the present invention.
Figure 2C:
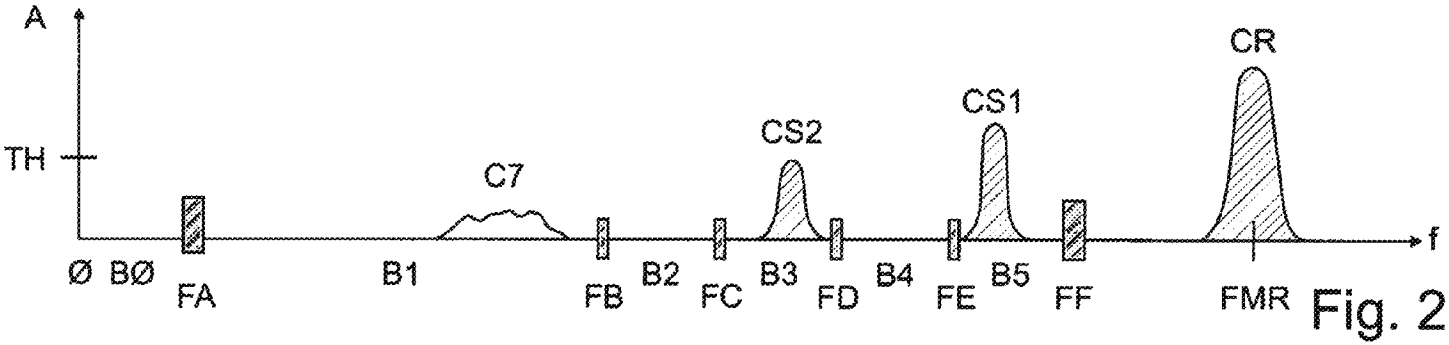
FIG. 2C shows a third spectrum of the radial vibration amplitude of a rotating compressor in a third regime (maximum operating speed) and a first example of a plurality of frequency bandwidths used for detecting rotating stall according to an embodiment of the present invention.

For better understanding the above steps of the method, a first example will be provided with reference to FIG. 2; each of the three plots of the vibration amplitude "A" versus the frequency "f" in FIG. 2 represents a possible frequency spectrum of the same compressor in three different regimes: FIG. 2A corresponds to the condition when the rotor rotates at the rated speed, FIG. 2B corresponds to the condition when the rotor rotates at the minimum operating speed, FIG. 2C corresponds to the condition when the rotor rotates at the maximum operating speed; in the specific case of FIG. 2A, no stall is occurring; in the specific case of FIG. 2B, no stall is occurring; in the specific case of FIG. 2C, at least one stall is occurring.

The frequency bandwidths used for detecting rotating stall are five, namely B1, B2, B3, B4 and B5. These bandwidths are fixed, non-overlapping and adjacent; this means that the maximum frequency FM1 of the first bandwidth B1 corresponds to the minimum frequency Fm2 of the second bandwidth B2 (FB=e.g. 109.6 Hz), the maximum frequency FM2 of the second bandwidth B2 corresponds to the minimum frequency Fm3 of the third bandwidth B3 (FC=e.g. 118.4 Hz), the maximum frequency FM3 of the third bandwidth B3 corresponds to the minimum frequency Fm4 of the fourth bandwidth B5 (FD=e.g. 132.0 Hz), the maximum frequency FM4 of the fourth bandwidth B4 corresponds to the minimum frequency Fm5 of the fifth bandwidth B5 (FE=e.g. 147.1 Hz); the minimum frequency Fm1 of the first bandwidth B1 has been appropriately chosen (FA=e.g. 6.0 Hz) in order not to detect "surge" vibrations; the maximum frequency FM5 of the fifth bandwidth B5 has been appropriately chosen (FF=e.g. 164.0 Hz) in order not to detect the normal vibration of the rotor when the rotor rotates either at rated speed (FRR=e.g. 183.3 Hz) or at maximum speed (FMR=e.g. 192.5 Hz).

In the specific example considered with reference to FIG. 2, the five bandwidths B1, B2, B3, B4 and B5 have different widths even if, in the figure, bandwidths B2, B3, B4 and B5 look equally wide; in general, using the same width for all bandwidth will lead to a greater number of bandwidths.

According to this example the same "predetermined value", or "threshold value" TH, is used for the amplitude comparison in each of the five bandwidths B1, B2, B3, B4 and B5; the use of different threshold values in distinct bandwidths is not to be excluded.

In this example, five frequency bandwidths are used. In alternative examples a different numbers of bandwidths may be used; the number should be not too small and not too high; the minimum preferred numbered is four; the maximum preferred number is ten; the best number to be used depends also on the characteristics of the bandwidths (i.e. whether fixed-position or moving and whether fixed-width or variable-width and whether uniform-width or different-width).

It is to be noted that a sixth bandwidth B0, from 0 Hz to the minimum frequency Fm1 of the first bandwidth B1 (FA=e.g. 6.0 Hz), is shown in FIG. 2; high-amplitude vibrations in this low-frequency bandwidth are an indicator of an already "existing surge" and not of an "incipient surge" (independently from the regime of the compressor). Therefore, if the unit 9 is able to consider such a low-frequency bandwidth of the frequency spectrum of the vibration measurement signal, i.e. below all the other frequency bandwidths, it may signal "surge", or "existing surge."

In FIG. 2A, the frequency spectrum comprises four components: CR, C1, C2, C3. The vibration component CR corresponds to the vibration component directly due to rotation of the compressor rotor and, therefore, it is centered at the rotation frequency (in this case the compressor rated frequency FR); the maximum magnitude (or amplitude) of the component CR is well above the threshold TH, but this is normal. The component C1 falls within the first bandwidth B1 and has a maximum magnitude below the threshold TH; therefore, this component is not due to a rotating stall. The component C2 falls partially within the third bandwidth B3 and partially within the fourth bandwidth B4 and has a maximum magnitude below the threshold TH (in any of the two bandwidths); therefore, this components is not due to a rotating stall. The component C3 falls within the fifth bandwidth B5 and has a maximum magnitude below the threshold TH; therefore, this component is not due to a rotating stall. Considering the steps (from A to G) explained before, there is no frequency bandwidth to be neglected as none of the five bandwidths (B1 to B5) comprise or is above the rotation frequency of the rotor (and any of the frequencies in the limited bandwidth of its vibration component).

In FIG. 2B, the frequency spectrum comprises four components: CR, C4, C5, C6. The vibration component CR corresponds to the vibration component directly due to rotation of the compressor rotor and, therefore, it is centered at the rotation frequency (in this case the compressor minimum operating frequency Fm); the maximum magnitude (or amplitude) of the component CR is well above the threshold TH, but this is normal. The component C4 falls within the first bandwidth B1 and has a maximum magnitude below the threshold TH; therefore, this component is not due to a rotating stall. The component C5 falls partially within the first bandwidth B1 and partially within the second bandwidth B2 and has a maximum magnitude below the threshold TH (in any of the two bandwidths); therefore, this components is not due to a rotating stall. The component C6 falls out of any of the five bandwidths (from B1 to B5) and, therefore, is not even considered by the processing (in any case, its amplitude is below the threshold TH). Considering the steps of the method explained before, there are three frequency bandwidths to be neglected: the third bandwidth B3 as it comprises the component CR, and the fourth and the fifth bandwidths B4 and B5 as they are above the rotation frequency Fm of the rotor.

In FIG. 2C, the frequency spectrum comprises four components: CR, CS1, CS2, C7. The vibration component CR corresponds to the vibration component directly due to rotation of the compressor rotor and, therefore, it is centered at the rotation frequency (in this case the compressor maximum operating frequency FM); the maximum magnitude (or amplitude) of the component CR is well above the threshold TH, but this is normal. The component C7 falls within the first bandwidth B1 and has a maximum magnitude below the threshold TH; therefore, this component is not due to a rotating stall. The component CS1 falls within the fifth bandwidth B5 and has a maximum magnitude well above the threshold TH; therefore, this components is considered to be due to a rotating stall. The component CS2 falls within the third bandwidth B3 and has a maximum magnitude slightly above the threshold TH; therefore, this components is considered to be due to a rotating stall. Considering the steps of the method explained before, there is no frequency bandwidth to be neglected as none of the five bandwidths (B1 to B5) comprise or is above the rotation frequency of the rotor (and any of the frequencies in the limited bandwidth of its vibration component).

Therefore, it is clear from the above example that, depending on the rotation frequency of the rotor in a specific moment of operation of the (same) compressor, none or one or more bandwidths are neglected.

For the sake of completeness, according to a very specific exemplary embodiment of the present invention, the compressor to be monitored has Fmin=119.16 Hz (minimum value of rotation frequency), Frat=183.33 Hz (rate value of rotation frequency), Fmax=192.50 (maximum value of rotation frequency) and five fixed, non-overlapping and adjacent bandwidths are used:

First bandwidth: from 6.0 Hz to 109.6 Hz

Second bandwidth: from 109.6 Hz to 118.4 Hz

Third bandwidth: from 118.4 Hz to 132.0 Hz

Fourth bandwidth: from 132.0 Hz to 147.1 Hz

Fifth bandwidth: from 147.1 Hz to 164.0 Hz

The determination of the bandwidth (in the case of fixed, non-overlapping and adjacent bandwidths) is carried out in the following way. A coefficient K is considered; K is assumed to be in the range from e.g. 0.87 (so to remain a bit above 85%) to e.g. 0.95 (so to remain a bit below 100%);

Lower limit of first bandwidth=F1=any value within e.g. 5.0-10.0 Hz (so to exclude very low frequencies).

Upper limit of first bandwidth=Lower limit of second bandwidth=F2=Fmin*K (so that 85% of Fmin falls within the first bandwidth).

Upper limit of second bandwidth=Lower limit of third bandwidth=F3=F2/K (so not to exclude 85%).

Upper limit of third bandwidth=Lower limit of fourth bandwidth=F4=F3/K (so not to exclude 85%).

Upper limit of X bandwidth=Lower limit of X−1 bandwidth=F(X)=F(X−1)/K.

Further bandwidths are allocated till a frequency is reached comprised between 0.85*Fmax and 0.95*Fmax; ideally F(X)=K*Fmax.

Based on these equations, an appropriate value of K is chosen in the above mentioned range.

Figure 3A:
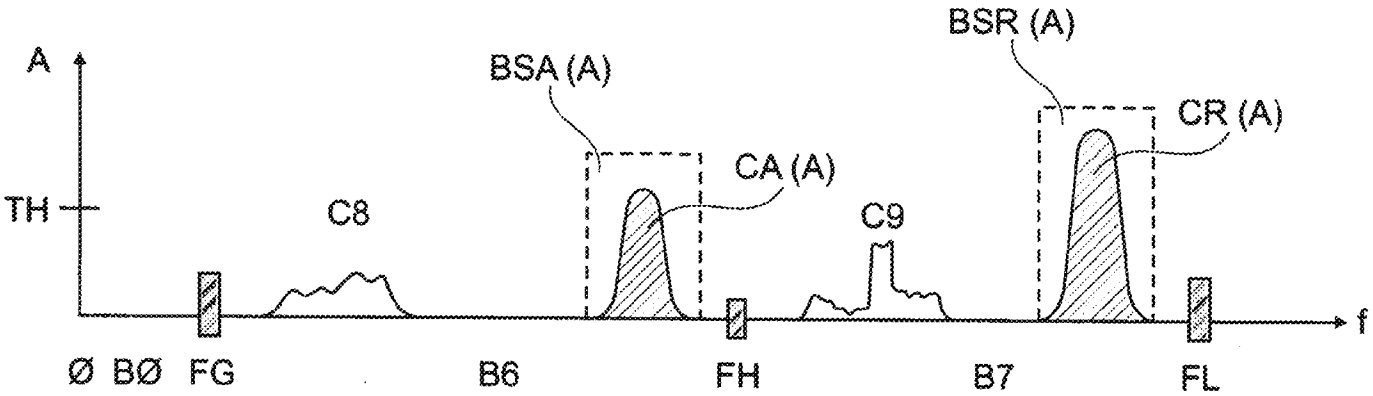
FIG. 3A shows a fourth spectrum of the radial vibration amplitude of a rotating compressor in a fourth regime (maximum operating speed) and a second example of a plurality of frequency bandwidths used for detecting rotating stall according to an embodiment of the present invention.
Figure 3B:
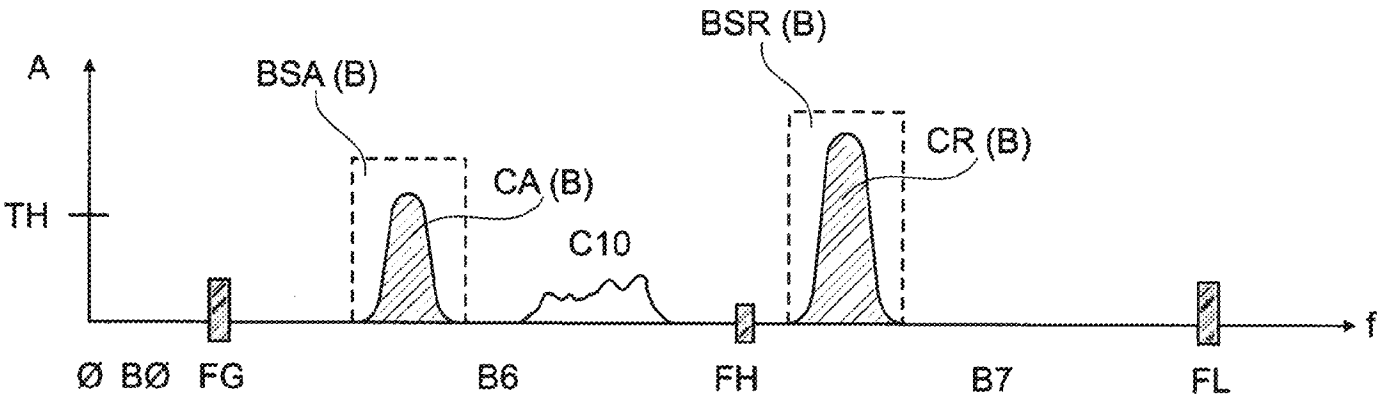
FIG. 3B shows a fifth spectrum of the radial vibration amplitude of a rotating compressor in a fifth regime (minimum operating speed) and a second example of a plurality of frequency bandwidths used for detecting rotating stall according to an embodiment of the present invention.

For better understanding the steps of the method, a second example will be provided with reference to FIG. 3; each of the two plots of the vibration amplitude "A" versus the frequency "f" in FIG. 3 represents a possible frequency spectrum of the same compressor in two different regimes: FIG. 3A corresponds to the condition when the rotor rotates at the maximum operating speed (e.g. 190 Hz), FIG. 3B corresponds to the condition when the rotor rotates at the minimum operating speed (e.g. 120 Hz); in both these two specific cases, no stall is occurring.

In the example of FIG. 3, there are two fixed frequency bandwidths B6 and B7 that are also non-overlapping and adjacent; this means that the maximum frequency FM6 of the bandwidth B6 corresponds to the minimum frequency Fm7 of the bandwidth B7; therefore, these bandwidths identify three frequencies FG (e.g. 6 Hz), FH (e.g. 100 Hz, i.e. 120-20, 20 being slightly more than 10% of 190) and FL (e.g. 210 Hz, i.e. 190+20, 20 being slightly more than 10% of 190); (FB=e.g. 109.6 Hz); there is also a bandwidth B0 identical to that of FIG. 2. The bandwidth B7 has been chosen so that the component CR of frequency spectrum at the rotor rotation frequency falls always within this bandwidth: in FIG. 3A the component CR(A) is in the upper range of the bandwidth B7 as the rotation frequency is maximum, in FIG. 3B the component CR(B) is in the lower range of the bandwidth B7 as the rotation frequency is minimum. The bandwidth B6 has been chosen so that a component CA of the frequency spectrum at half the rotor rotation frequency (so called "first sub-harmonic") falls within this bandwidth; in FIG. 3A the component CA(A) is in the upper range of the bandwidth B6; in FIG. 3B the component CA(B) is in the lower range of the bandwidth B6 (even if far from the lower limit FG).

In this example, both components CR and CA are not to be considered for detecting stall as they are normal (in some kind of compressors, the rotation of the rotor generates vibration not only at the rotation frequency but also at half the rotation frequency), independently from their magnitudes. In order to take this into account, two fixed-width (the width of BSR is e.g. 40 Hz i.e. slightly more than 20% of 190, the width of BSA is e.g. 20 Hz i.e. BSR/2) and moving bandwidths BSR and BSA are used; in FIG. 3 they correspond to the suppression bandwidths of a two suppression-band filters tracked to the rotation frequency of the rotor: bandwidth BSR covers component CR and bandwidth BSA covers component CA.

The combination of the two fixed-position and fixed-width bandwidths B6 and B7 and the two variable-position and fixed-width bandwidths BSA and BSR may be as four variable-position and variable-width bandwidths: the first bandwidth ranges from the frequency FG to the lower limit of the bandwidth BSA, the second bandwidth ranges from the upper limit of the bandwidth BSA to the frequency FH, the third bandwidth ranges from the frequency FH to the lower limit of the bandwidth BSR, the fourth bandwidth ranges from the upper limit of the bandwidth BSR to the frequency FL. Considering the steps (from A to G) explained before, there fourth bandwidth must always be neglected as it is always above the rotation frequency of the rotor (and any of the frequencies in the limited bandwidth of its vibration component).

In the specific regime of the compressor corresponding to FIG. 3A, there are two components C8 and C9; the component C8 falls within the first bandwidth; the component C9 falls within the third bandwidth; none of the components C8 and C9 has a maximum magnitude exceeding the threshold value TH and, therefore, no stall is occurring.

In the specific regime of the compressor corresponding to FIG. 3B, there is one component C10; the component C10 falls within the second bandwidth; the component C10 does not have a maximum magnitude exceeding the threshold value TH and, therefore, no stall is occurring.

Till now the description has considered only one radial vibration of the compressor, or, in other words, one vibration sensor (namely the first sensor 11) and one corresponding vibration measurement signal.

In the embodiment of FIG. 1, there are two radial vibration sensors, namely the first sensor 11 and the second sensor 10; each of the two sensors 10 and 11 are located on a different side of the rotor 2. In this way, a rotating stall may be effectively detected wherever is located (i.e. in a first end region of the rotor or in a second end region of the rotor or in a middle region of the rotor). When using such two sensors and their measurement signals, the above the steps of the method are carried out for each of the two signals; rotating stall is considered occurring if for at least one of the two signals the threshold value is exceeded in any of the non-neglected bandwidths. The electronic processing unit 9 is able to treat both signals separately and contemporaneously or substantially contemporaneously.

The present invention may be embodied in different forms. The embodiment of FIG. 4 differs from the embodiment of FIG. 1 in that there is a rotation sensor 12 connected to the unit 9 and adapted to measure the rotation speed or rotation frequency of the rotor 2 (precisely of the shaft 4); sensor 12 generates a rotation measurement signal that is received and processed by the unit 9.

The rotation measurement signal may be used by the electronic processing unit for determining one or more bandwidths to be neglected between the set of frequency bandwidths used for stall detection. For example, in the case of FIG. 2B, the signal from the sensor 12 would indicate that the rotation frequency of the rotor is Fm, the bandwidth B3 is neglected; alternatively, the electronic processing unit may decide to neglect the bandwidth B3 considering its very high maximum magnitude (much higher than the threshold value TH).

The rotation measurement signal may be used by the electronic processing unit for determining one or more limit frequencies (i.e. lower end and upper end) of one or more of the set of frequency bandwidths used for stall detection. For example, in the case of FIG. 3, would indicate the rotation frequency of the rotor at any time and consequently the electronic processing unit may determine the two bandwidths BSA and BSR at any time (two tracking filters may be used in this case).

Figure 5:
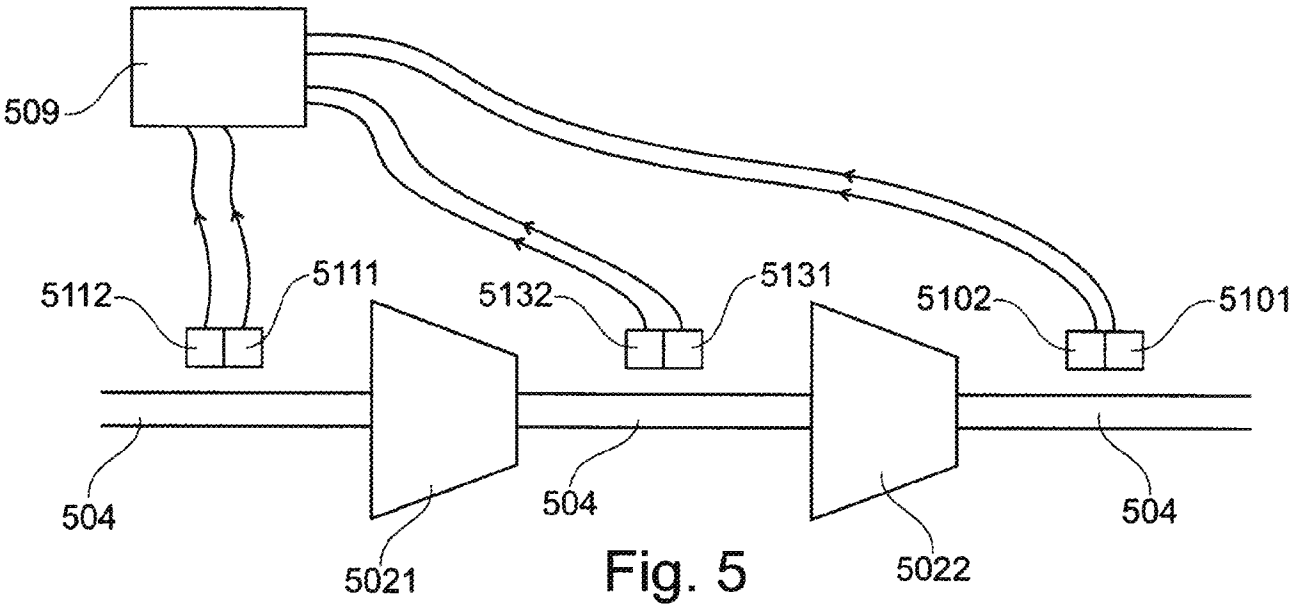
FIG. 5 shows very schematically a third compressor with associated a third embodiment of the equipment according to the present invention that differs from the first embodiment of FIG. 1 in that the compressor comprises two rotors and the equipment measures radial vibrations according to perpendicular directions—casing, bearings, inlets and outlet of the compressor are omitted.

The embodiment of FIG. 5 comprises two rotors 5021 and 5022 mounted on a same shaft 504 and three sensors couples of radial vibration sensors 5101+5102, 5111+5112, 5131+5132; all the sensors are connected to an electronic processing unit 509.

In this embodiment of the invention, radial two vibration sensors are coupled in order to more effectively detect radial vibration independently from the vibration direction. Referring to FIG. 6, there are a rotor RO (more precisely the shaft of a rotor) and a stator ST (more precisely the casing of a compressor); additionally there are a sensor XS arranged primarily to measure radial vibration along the X-axis and a sensor YS arranged primarily to measure radial vibration along the Y-axis; the sensors XS and YS form a couple with perpendicularly disposed measurement directions. When using such sensors couple and their measurement signals, the above the steps (from A to G) are carried out for each of the two signals; rotating stall is considered occurring if for at least one of the two signals the threshold value is exceeded in any of the non-neglected bandwidths. The electronic processing unit is able to treat both signals separately and contemporaneously or substantially contemporaneously.

According to the embodiment of FIG. 5, a first sensors couple 5111, 5112 is on one side of a first rotor 5021, a second sensors couple 5101, 5102 is on one side of the second rotor 5022, a third sensors couple 5131, 5132 is in-between the first rotor 5021 and the second rotor 5022. The electronic processing unit 509 is able to treat the measurement signals of all the sensors separately and contemporaneously or substantially contemporaneously.

It is to be noted that an electronic processing unit might be able to treat the measurement signals of many sensors associated from several compressors separately and contemporaneously or substantially contemporaneously.

It is apparent from the above description that embodiments of the present invention are designed to detect rotating stall in a compressor at different regimes and not only when the compressor is operating at rated speed.

Some embodiments of the equipment according to the present invention may be designed for a specific compressor.

Other embodiments may be designed for being used with different compressors; in this case, it might be useful to customize the equipment to the specific compressor at the time of installing the equipment; customization may relate for example to the number of bandwidths and their characteristics as well as to the one or more threshold values to be used for comparisons.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore

What is claimed is:

1. A method for detecting rotating stall in a compressor comprising a rotating rotor and a static stator, the rotor and the stator being subject to radial vibration and axial vibration, the method comprising:

measuring radial vibration of the rotor relative to the stator and correspondingly generating a vibration measurement signal;

calculating a frequency spectrum of the vibration measurement signal;

identifying a plurality of frequency bandwidths of the frequency spectrum;

neglecting one first frequency bandwidth of the plurality of frequency bandwidths if the rotation frequency of the rotor falls within the first frequency bandwidth;

neglecting at least one second frequency bandwidth of the plurality of frequency bandwidths if the rotation frequency of the rotor falls below the second frequency bandwidth;

determining the maximum magnitude of the spectrum in each of the non-neglected frequency bandwidths; and carrying out a comparison between each of the determined maximum magnitudes and a predetermined value, wherein rotating stall is considered occurring if at least one of the comparisons shows that the corresponding determined maximum magnitude is greater than the predetermined value.

2. The method of claim 1, wherein the plurality of frequency bandwidths are fixed.

3. The method of claim 2, wherein the plurality of frequency bandwidths are non-overlapping and adjacent.

4. The method of claim 2, wherein the plurality of frequency bandwidths have different widths.

5. The method of claim 1, further comprising:

identifying a further frequency bandwidth below all frequency bandwidths of the plurality of frequency bandwidths, wherein the further frequency bandwidth is used for detecting surge of the compressor.

6. The method of claim 1, wherein the plurality of frequency bandwidths of comprises between about four and about ten frequency bandwidths.

7. The method of claim 1, wherein measuring radial vibration of the rotor relative to the stator and correspondingly generating a vibration measurement signal comprises measuring components of the radial vibration according to two different directions.

8. The method of claim 7, wherein the two different directions are perpendicular.

9. The method of claim 7, wherein a single electronic processing unit is used for treating different or distinct measurements of radial vibration of the same compressor or of several compressors.

10. The method of claim 1, wherein measuring radial vibration of the rotor relative to the stator and correspondingly generating a vibration measurement signal comprises measuring the radial vibration on both sides of the rotor.

11. The method of claim 1, wherein neglecting one first frequency bandwidth of the plurality of frequency bandwidths, if the rotation frequency of the rotor falls within the first frequency bandwidth comprises measuring the rotation frequency of the rotor, or determining the rotation frequency of the rotor based on the maximum magnitude of the spectrum in each of the frequency bandwidths of the plurality of frequency bandwidths.

12. An apparatus for detecting rotating stall in a compressor comprising a rotating rotor and a static stator, the rotor and the stator being subject to radial vibration and axial vibration, the apparatus comprising:

at least one sensor configured to measure radial vibration of the rotor relative to the stator and correspondingly generate a vibration measurement signal, and an electronic processing unit configured to:

calculate a frequency spectrum of the vibration measurement signal;

identify a plurality of frequency bandwidths of the frequency spectrum;

neglect one first frequency bandwidth of the plurality of frequency bandwidths if the rotation frequency of the rotor falls within the first frequency bandwidth;

neglect at least one second frequency bandwidth of the plurality of frequency bandwidths if the rotation frequency of the rotor falls below the second frequency bandwidth;

determine the maximum magnitude of the spectrum in each of the non-neglected frequency bandwidths;

carry out a comparison between each of the determined maximum magnitudes and a predetermined value, and signal a rotating stall condition if at least one of the comparisons shows that the corresponding determined maximum magnitude is greater than the predetermined value.

13. A compressor comprising at least one rotating rotor and a static stator, and an apparatus for detecting rotating stall, wherein the apparatus comprises:

at least one sensor configured to measure radial vibration of the rotor relative to the stator and correspondingly generate a vibration measurement signal, and an electronic processing unit configured to:

calculate a frequency spectrum of the vibration measurement signal, identify a plurality of frequency bandwidths of the frequency spectrum, neglect one first frequency bandwidth of the plurality of frequency bandwidths if the rotation frequency of the rotor falls within the first frequency bandwidth, neglect at least one second frequency bandwidth of the plurality of frequency bandwidths if the rotation frequency of the rotor falls below the second frequency bandwidth, determine the maximum magnitude of the spectrum in each of the non-neglected frequency bandwidths, carry out a comparison between each of the determined maximum magnitudes and a predetermined value, and signal a rotating stall condition if at least one of the comparisons shows that the corresponding determined maximum magnitude is greater than the predetermined value.

* * * * *